United States Patent [19]

Okada et al.

[11] 4,084,542

[45] Apr. 18, 1978

[54] POSITIONING APPARATUS FOR MAGNETIC BRUSH DEVELOPING DEVICE

[75] Inventors: Ryuzo Okada; Yoshikazu Okamoto, both of Ebina, Japan

[73] Assignee: Rank Xerox, Ltd., London, England

[21] Appl. No.: 804,217

[22] Filed: Jun. 7, 1977

[30] Foreign Application Priority Data

Jun. 16, 1976 Japan ..... 51-069746

[51] Int. Cl.[2] ..... G03G 15/09

[52] U.S. Cl. ..... 118/658

[58] Field of Search ..... 118/658

[56] References Cited

U.S. PATENT DOCUMENTS

| | | | |
|---|---|---|---|
| 3,697,050 | 10/1972 | Stanley | 118/658 X |
| 3,703,395 | 11/1972 | Drexler et al. | 118/658 |
| 3,872,829 | 3/1975 | Rattin | 118/658 |
| 3,893,414 | 7/1975 | Hudson | 118/658 |
| 3,911,864 | 10/1975 | Hudson | 118/658 X |
| 3,937,181 | 2/1976 | Handa | 118/658 |
| 3,945,342 | 3/1976 | Drummond, Jr. | 118/658 |
| 3,977,361 | 8/1976 | Nagashima et al. | 118/658 |
| 3,995,590 | 12/1976 | Volkers | 118/658 |
| 4,022,157 | 5/1977 | Rasekhi et al. | 118/658 |
| 4,030,447 | 6/1977 | Takahashi et al. | 118/658 |

*Primary Examiner*—Mervin Stein
*Assistant Examiner*—Andrew M. Falik

[57] ABSTRACT

An improved magnetic brush developing device mounted adjacent to a photosensitive member has a magnet and a cylinder mounted to rotate around the periphery of the magnet. The magnet is stationary during operation of the device, but the magnet is mounted so that its position relative to the photosensitive member can be changed each time a predetermined number of copies has been made. This arrangement solves two problems caused by developer which has deteriorated from use, the problems being (1) poor reproduction of a low contrast image, and (2) staining the background of an image.

1 Claim, 4 Drawing Figures

POSITIONING APPARATUS FOR MAGNETIC BRUSH DEVELOPING DEVICE

BACKGROUND OF THE INVENTION

The present invention relates to a magnetic brush developing device for use in electrophotographic copying machines.

The magnetic brush developing device is widely used as a developing device in electrophotographic copying machines, and is constructed such that a developer comprising a thermoplastic resin colored powder (referred to as toner hereinbelow) and a magnetic carrier (referred to as carrier hereinbelow) is moved by means of a magnetic roller so as to keep the developer in sliding contact with a photosensitive member. After a period of time, the toner will deposit by fusion on the surface of the carrier, and consequently the triboelectric properties of the toner deteriorate.

As a result, a difficulty arises in which the background of the image obtained is stained black by the above-mentioned phenomenon.

This phenomenon is caused by a reduction in the static charge on the toner. To prevent the occurrence of the above-mentioned phenomenon, a developer can be used which initially has a higher charging characteristic than that actually required. If under the initial condition, however, the developer has a charging characteristic higher than that required, the reproducibility of an image with a low contrast (referred to as low contrast image) relative to the background of the original will be reduced.

SUMMARY OF THE INVENTION

The present invention has been devised in the light of the above-mentioned circumstances, and one object of this invention is to provide a magnetic brush developing device which not only eliminates stain on the background of the image, but also prevents poor reproduction of a low contrast image under the initial condition.

This magnetic brush developing device is mounted adjacent to a photosensitive member, and includes a magnet and a cylinder rotatably mounted around the periphery of the magnet, the magnet being mounted so that its position relative to the photosensitive member can be changed each time a predetermined number of copies is made.

DETAILED DESCRIPTION OF THE INVENTION

Figure 1:
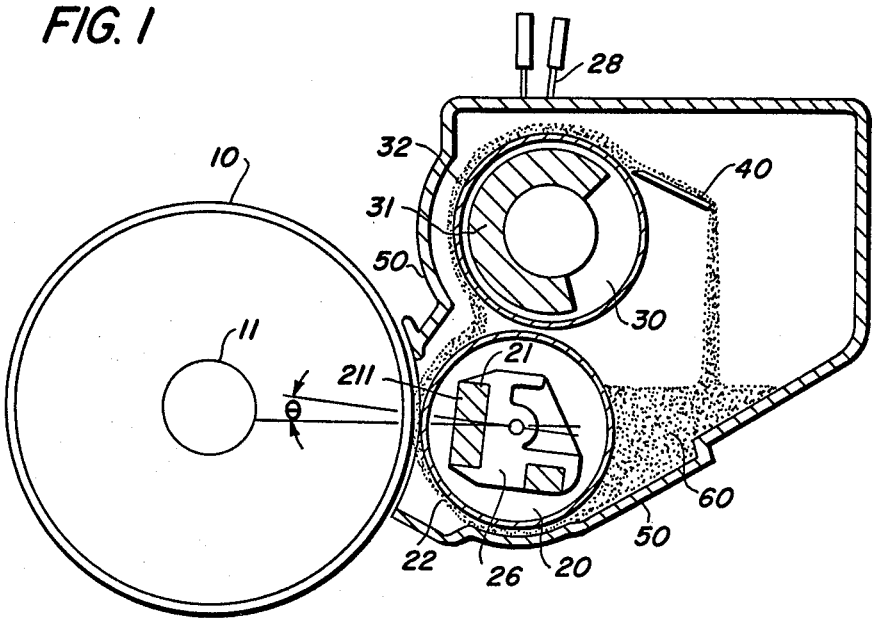
FIG. 1 is a sectional view of one embodiment of the present invention.
Figure 2:
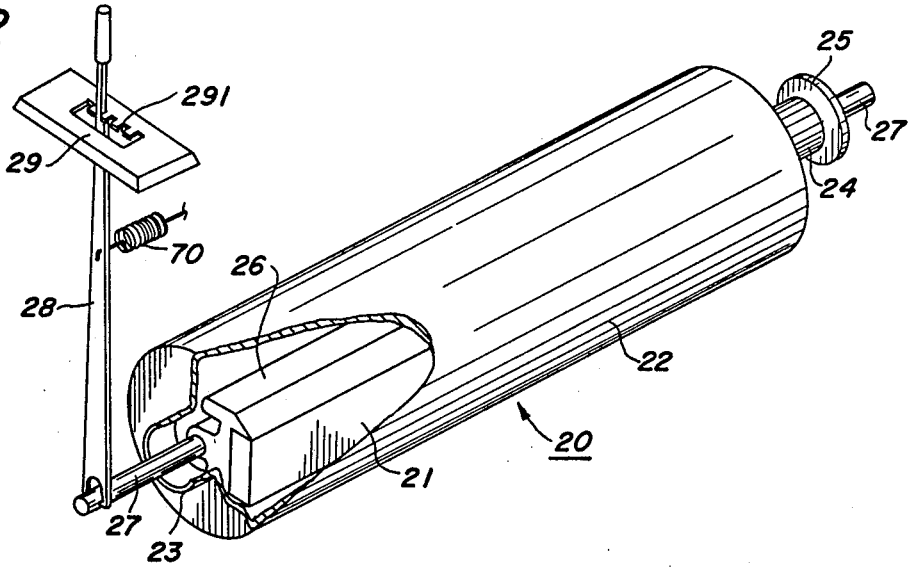
FIG. 2 is a partially broken perspective view of a developing roller.

Referring to FIG. 1, reference numeral 10 denotes an image forming member such as a photosensitive drum which has a rotary shaft 11. Reference numeral 20 denotes a magnetic brush developing roller for effecting development, the roller including a fixed magnet 21 mounted on a support 26, and a cylinder 22 rotatable around the periphery of the magnet 21. Reference numeral 30 denotes a conveyor roller which comprises a magnet 31 and a cylinder 32 rotatable around the periphery of the magnet 31. A conveyor roller 30 serves to move developer agent 60 upwardly from the roller 20. The developer 60 is attracted to the surface of the cylinder 22 by the magnetic force of the magnet 21 and is moved upwardly by the rotation of the cylinder 22, the developer being kept in sliding contact with the photosensitive surface of the image forming member 10 so as to effect development. Developer which has completed development is moved further upwardly by the action of the conveyor roller 30, and is scraped off by a scraper plate 40 positioned so as to permit the developer to slide downwardly over the upper surface of the scraper plate. Developer 60 is thus circulated with developer housing 50 by way of the magnetic brush developing roller 20 and the conveyor roller 30.

The cylinder 22 has at both ends thereof flange portions 23 and 24, and is supported through bearings (not shown) within the developer container 50. The flange portion 24 has fixedly secured thereto a gear 25 which is coupled to an external driving power supply. Within the cylinder 22, the magnet 21 is fixedly secured by the supporting means 26 as mentioned above. The supporting means 26 has a shaft 27 extending through the axis of rotation of the cylinder 22, and the shaft 27 is carried through bearings (not shown) independent of those for the cylinder 22 by and within the developer container 50.

Connected to one end of the shaft 27 is an arm 28 which engages with a graduated plate 29 located at a proper place in the developer container. The graduated plate 29 has a plurality of grooves 291 formed therein in which the arm 28 is fitted by the biasing force of a spring 70.

As mentioned above, movement of the arm 28 engaged by the graduated plate 29 enables the magnet within the cylinder 22 to be rotated about the shaft 27. A magnet setting angle of 0° means that the surface 211 of the fixed magnet 21 opposite to the photosensitive drum is located perpendicular to the horizontal plane.

In such a condition, the plane which includes the rotary axis 11 of the image forming member 10 and the rotary shaft of the developing roller 30 is inclined relative to the horizontal plane by about 3°.

Figure 3:
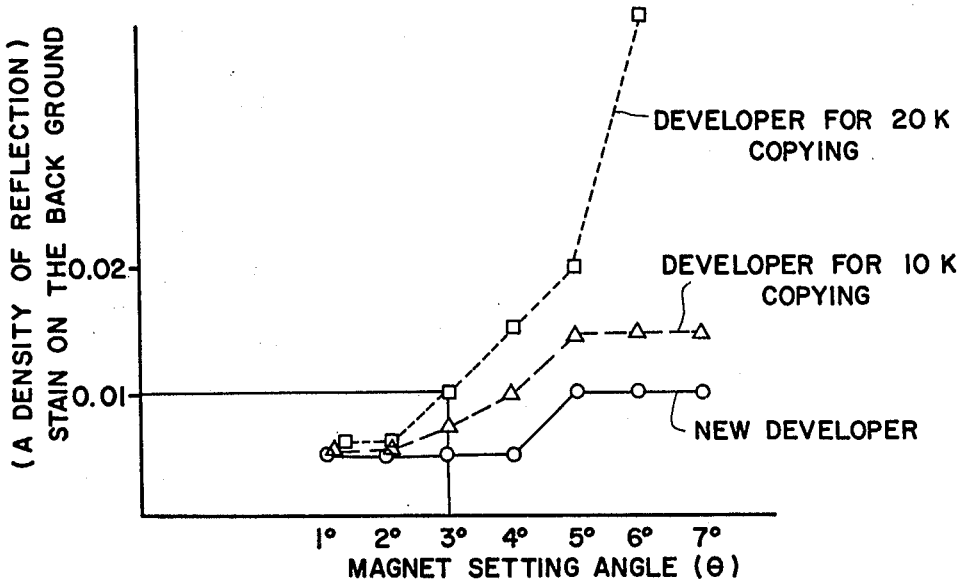
FIG. 3 is a diagram showing the relationship between the magnet setting angle, the stain on the background, and the length of time using developer.

The relationship between the magnet setting angle, the stain on the background, and the length of time of using developer is shown in FIG. 3. It can be seen from FIG. 3 that the stain on the background increases with increase in the magnet setting angle and with the deterioration of the developer.

Figure 4:
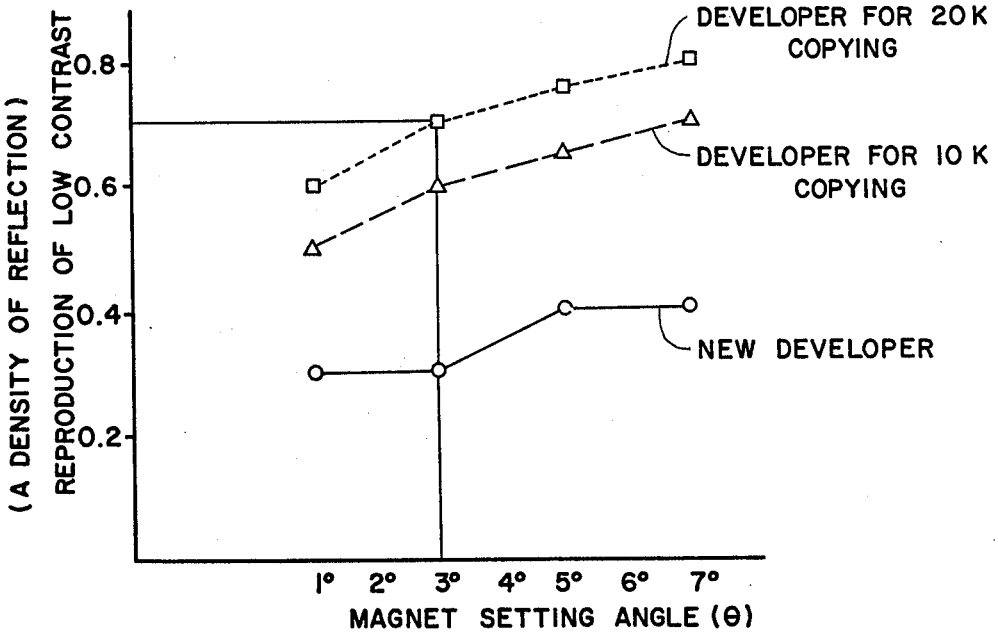
FIG. 4 is a diagram showing the relationship between the magnet setting angle, the reproducibility of a low contrast image, and the length of time of using developer.

In addition, the relationship between the magnet setting angle, the reproducibility of a low contrast image, and the length of time of using developer is shown in FIG. 4. This figure shows that the reproducibility of low contrast image is improved with increase in the magnet setting angle and with the deterioration of the developer.

In view of the foregoing, as long as the developer is deteriorated and the magnet setting angle is kept constant, the poor reproducibility of low contrast image in the initial stage or the problem on the stain on the background by deteriorated developer will always take place.

It is usually accepted that the reproducibility of low contrast image is kept at a density of reflection of more than 0.4 and the stain on the background of image is kept at a density of reflection of less than 0.01. The density of reflection can be given by log (I/Io), which Io represents the amount of light reflected by an original, and I the amount of light reflected by copies.

This means that when the magnet setting angle is 5° and developer is used for 10k copying, the problem of stain on the background of an image will occur.

If the initial magnet setting angle is 5° and is reduced by one degree each time the developer is used for 10k copying, a magnet setting angle of three degrees is obtained for the developer used for 20k copying so that the reproduction of low contrast image is kept at a density of reflection of 0.7 and the stain on the background is kept at a density of reflection of 0.01. Therefore both figures come under the above-mentioned allowable range.

By altering or adjusting the magnet setting angle with increase or decrease in the number of copies to be taken (or the length of time of using developer), low contrast image reproducibility and stain on the background can be kept within the allowable range. Therefore, an image with fair quality can be obtained repeatedly with the same developer. Experiments have shown that the same developer can be used repeatedly more than three times as long as in a conventional system.

Alteration of the magnet setting angle may be automatically effected, or it may be manually effected by a serviceman or operator, and either arrangement is within the scope of the present invention.

What is claimed is:

1. An improved magnetic brush developing device for developing an electrostatic latent image on a photosensitive member disposed adjacent to the device, the device including a magnet and a cylinder mounted to rotate around the magnet to bring developer into contact with the photosensitive member, the improvement comprising:

means for rotating the magnet to and fixedly holding the magnet in any one of a plurality of predetermined positions relative to the photosensitive member, the rotating and holding means including means having a plurality of grooves formed therein, each of the grooves defining one of the predetermined positions, a handle mounted for movement between the grooves, and means for holding the handle in any one of the grooves.

* * * * *